US011690400B2

(12) United States Patent
Abal-Sadeq et al.

(10) Patent No.: US 11,690,400 B2
(45) Date of Patent: Jul. 4, 2023

(54) SELF-IGNITING CAP FOR A PIPE

(71) Applicant: E-Cone LLC, Redding, CA (US)

(72) Inventors: Seth Abal-Sadeq, Redondo Beach, CA (US); Allen Amirpanah, Torrance, CA (US)

(73) Assignee: E-Cone LLC, Redding, CA (US)

( * ) Notice: Subject to any disclaimer, the term of this patent is extended or adjusted under 35 U.S.C. 154(b) by 490 days.

(21) Appl. No.: 17/006,729

(22) Filed: Aug. 28, 2020

(65) Prior Publication Data

US 2022/0061380 A1 Mar. 3, 2022

(51) Int. Cl.
*A24F 5/10* (2006.01)
*A24F 9/02* (2006.01)

(52) U.S. Cl.
CPC ..... *A24F 5/10* (2013.01); *A24F 9/02* (2013.01); *A24F 2700/08* (2013.01)

(58) Field of Classification Search
CPC ..... A24F 5/10; A24F 9/16
See application file for complete search history.

(56) References Cited

U.S. PATENT DOCUMENTS

| | | | | |
|---|---|---|---|---|
| 10,349,680 | B2 | 7/2019 | Memari et al. | |
| 2009/0283102 | A1* | 11/2009 | Larios | A24F 3/00 131/222 |
| 2017/0347716 | A1 | 12/2017 | Tucker et al. | |
| 2018/0000158 | A1 | 1/2018 | Ewing et al. | |
| 2018/0092406 | A1 | 4/2018 | Monsees et al. | |
| 2019/0110519 | A1 | 4/2019 | Meyer et al. | |

FOREIGN PATENT DOCUMENTS

| | | | |
|---|---|---|---|
| CA | 2718771 | A1 | 1/2011 |
| EP | 2422633 | A1 | 2/2012 |
| EP | 2787846 | B1 | 3/2016 |
| WO | 2017084818 | A1 | 5/2017 |

* cited by examiner

*Primary Examiner* — Kelly M Gambetta
*Assistant Examiner* — Jennifer A Kessie
(74) *Attorney, Agent, or Firm* — Thomas Coester Intellectual Property

(57) ABSTRACT

An apparatus to automatically ignite herbs in a water pipe. The apparatus includes a cap dimensioned to engage a bowl piece of a water pipe and provide a restricted air path to the bowl. A pressure sensor within the cap senses a pressure change response to air being drawn through the air path. Responsive to a signal from the sensor a controller drives an igniter to ignite the herb within the bowl.

12 Claims, 6 Drawing Sheets

SELF-IGNITING CAP FOR A PIPE

BACKGROUND

Field of the Invention

Embodiments of the inventions relate to a igniting combustible material in a pipe. More particularly, embodiments of the invention relate to a self-ignitor for a pipe.

Background

Waterpipes commonly referred to as "bongs" are a popular device for smoking various herbal substances. Bongs come in a myriad shapes and sizes with various features and optional accessories. In general, there are a number of parts that are common to these devices a bowl (or bowl piece) in which herb is placed for combustion, a water chamber, a conduit (stem) between the bowl and water chamber and a neck in communication with the water chamber, the neck terminating in a mouthpiece. Other features may include an ice pinch in the neck, a percolator, a splash guard etc.

The bowl piece is typically though not always separable from the remainder of the bong. It includes a bowl in which the herb to be smoked is placed, a stem that provides an airpath that connects (directly or indirectly) to the water chamber and often a handle that allow the bowl piece to be manipulated when it is hot.

In use, herb is placed in the bowl, and a flame is held to the herb, typically in the form of either a lighter (e.g. butane lighter) or a match. A user then inhales through the mouthpiece drawing the resulting smoke through the water and into the users mouth or lungs. This mechanism of lighting has some notable problems. First, when used in outdoor environments, it can be difficult to maintain the flame sufficiently to achieve the desired ignition, for example as a result of wind or other ambient conditions. Second, some users experience negative tastes during consumption as a result of the sulfur in matches or the chemicals released by other lighters such as combustion of butane.

BRIEF DESCRIPTION OF THE DRAWINGS

Embodiments of the invention are illustrated by way of example and not by way of limitation in the figures of the accompanying drawings in which like references indicate similar elements. It should be noted that different references to "an" or "one" embodiment in this disclosure are not necessarily to the same embodiment, and such references mean at least one.

DETAILED DESCRIPTION

Figure 1:
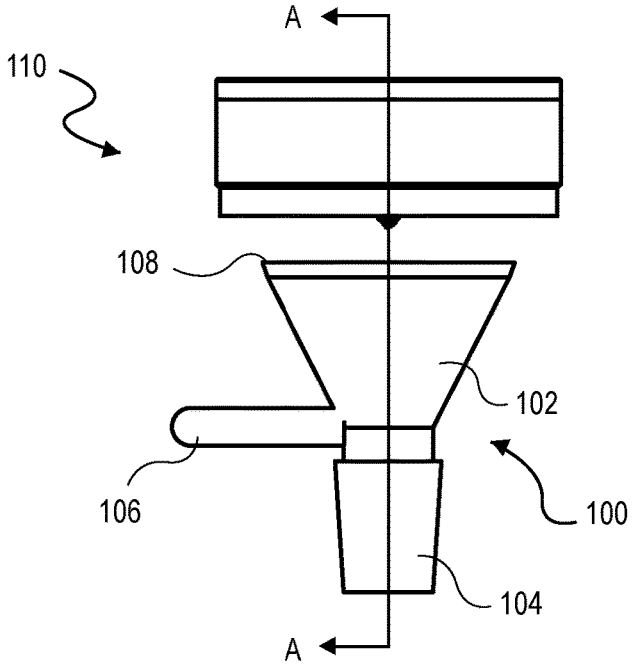
FIG. 1 is a perspective view of a bowl piece and igniter cap of one embodiment of the invention.

FIG. 1 is a perspective view of a bowl piece and igniter cap of one embodiment of the invention. Bowl piece 100 has a bowl 102 in which herbal components are placed during use for combustion. Bowl 102 has a lip 108. Bowl piece 100 also has a stem 104 that provides the trough path to a water chamber of a water pipe and a handle 106 that allows a user to manipulate the bowl piece 100 with reduced risk of burn should the bowl 102 become hot during use. Some embodiments may omit handle 106. In various embodiments, bowl piece 100 may be a conventional bowl piece commercially available today or it may be specifically designed to work with igniter cap 110. Generally, bowl piece 100 will be formed of glass, metal or a combination of glass and metal.

Igniter cap 110, in use, engages with or is coupled to the bowl piece 100. As described more fully below igniter cap 100 provides sufficient heat to cause combustion of herbs within the bowl 102 responsive to sensing a pressure event.

Figure 2:
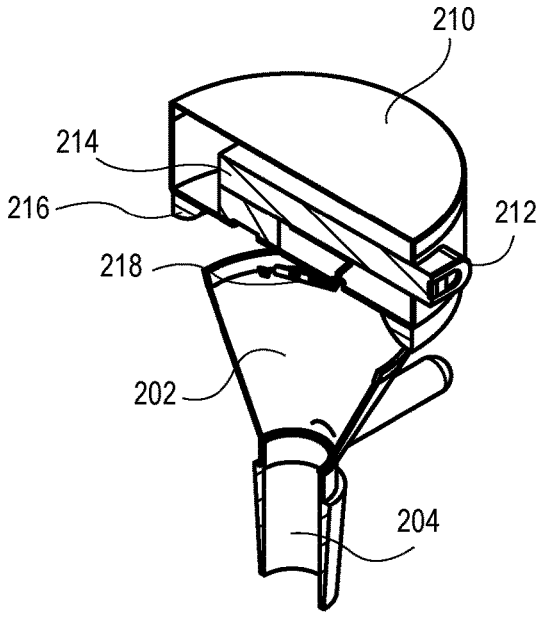
FIG. 2 is an elevated perspective view of the apparatus of FIG. 1 taken through section A-A.

FIG. 2 is an elevated perspective view of the apparatus of FIG. 1 taken through section A-A. In this view, the interior 202 of the bowl 102 as well as air path 204 through the stem 104 can be seen. Igniter cap 110 has a housing 210 that contains a power source 216. Housing 210 may be formed from metal, glass, or suitable temperature resistant synthetic materials. In some embodiments, portions of housing 210 may be porous to allow air to flow through. In other embodiments, explicit inlet ports may be defined in the housing. As used here in "inlet" refers to a flow direction into the cap from the ambient environment and "outlet" refer to a flow direction out of the cap into the bowl.

In some embodiments, power source 216 may be a battery. In some embodiments, the power source 216 may be a 3.7 V lithium ion battery. In some embodiments the battery is removable and replaceable. In other embodiments the battery may be rechargeable in situ. Where the battery is rechargeable in situ, an external charging port 212 may be provided. Charging port could be micro USB, Mini USB, USB, lightning connector or any other electrically suitable connector for charging the power source 216. In an alternate embodiment, the battery is coupled to and inductive charging circuit within the cap 110 to allow the battery to be charged wirelessly. Some embodiments include both an external charging port 212 and support for wireless charging.

Power source 216 is electrically coupled to igniter 218. In one embodiment, igniter 218 is a resistive coil. In use power source 218 delivers current to the igniter 216 causing it to generate heat in an amount sufficient to cause combustion of the herbs within the bowl 102. For most practical uses it is sufficient if the igniter generates localize heat at or above 450° F.

A sensor is provided within the housing 210 to detect a pressure change, caused, for example, by a user drawing on the mouthpiece of the water pipe to which the bowl piece 100 is connected. A controller 214 within the housing 210 reads the sensor and drives the power source 216 responsive to the sensor output. Controller 214 could be for example a microcontroller, a microprocessor, application specific integrated circuit (ASIC), field programmable gate array (FPGA) or the like. The power source 216 also provides power to the controller 216 and any other resident circuitry.

The required processing power is small so very low power components are suitable and desired.

Figure 3:
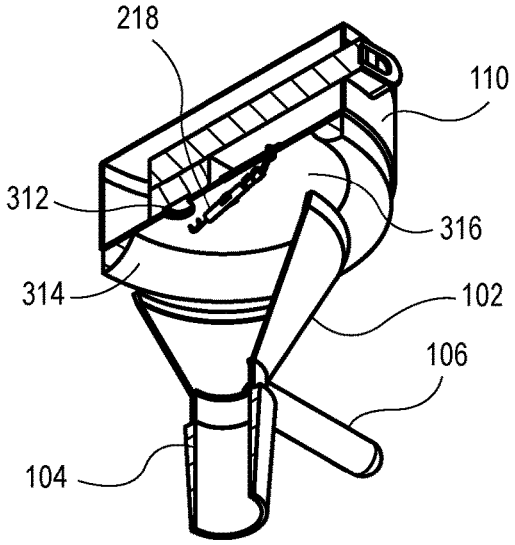
FIG. 3 is a bottom perspective view of the apparatus of FIG. 1 taken through section A-A.

FIG. 3 is a bottom perspective view of the apparatus of FIG. 1 taken through section A-A. In this view, the bottom 316 of the housing 210 can be seen. Bottom 316 define at least one outlet port 312 though which air is drawn when a user draws on the mouthpiece of the pipe to which the bowl piece 100 is connected. The outlet port 312 provides a restricted flow path that allows the pressure sensor to detect the pressure change caused by the users draw. Selection of the size of the outlet port influences the sensitivity of the sensor required and also dictates the ease with which a user can draw air through the cap.

Igniter 218 extends through a slot in the bottom of the housing such that in use it will extend into the bowl 104 and contact the herbs therein. In some embodiments, the bottom 316 is formed of a heat insulating material to protect the components inside from the heat associated with the herb combustion. In other embodiments, bottom 316 may be for example metallic and a heat insulating layer separately resides within the housing. In some embodiments, the cap 110 has gasket 314 coupled thereto. In use gasket engage the lip 108 of bowl 202 and provides a substantially hermetic seal therewith. As used herein, "substantially hermetic seal" means that the air that leaks through the seal is <<the air passing through the flow path defined within the cap 110. The gasket 314 could be an o-ring, flat gasket or the like. Generally, gasket 314 will be formed of some type of elastomeric material. A high temperature elastomer such as perfluoroelastomer (FFKM) material is suitable. Some embodiment may use silicone or fluorocarbon elastomers. Preferably the gasket 314 is configured to engage the outer edge of the lip 108 of the bowl 102 so that the elastomer is well removed from the combustion zone in the interior 202 of the bowl 102.

Some embodiments do not couple to the bowl piece but rather can be held in engagement with the bowl piece by a user. However, it is preferred that the cap couple to the bowl piece for convenience. For convenience it is also desirable that the cap provide easy access to bowl 102 so the bowl 102 can be easily refilled when the herb must be replenished. Various coupling members have been found suitable to permit acceptable ease of access and adequate stability for use with out the user holding the cap in place. Without limitation acceptable coupling member include hinged collar, magnetic coupler, threading, pressure fit and combinations of the forgoing.

Figure 4:
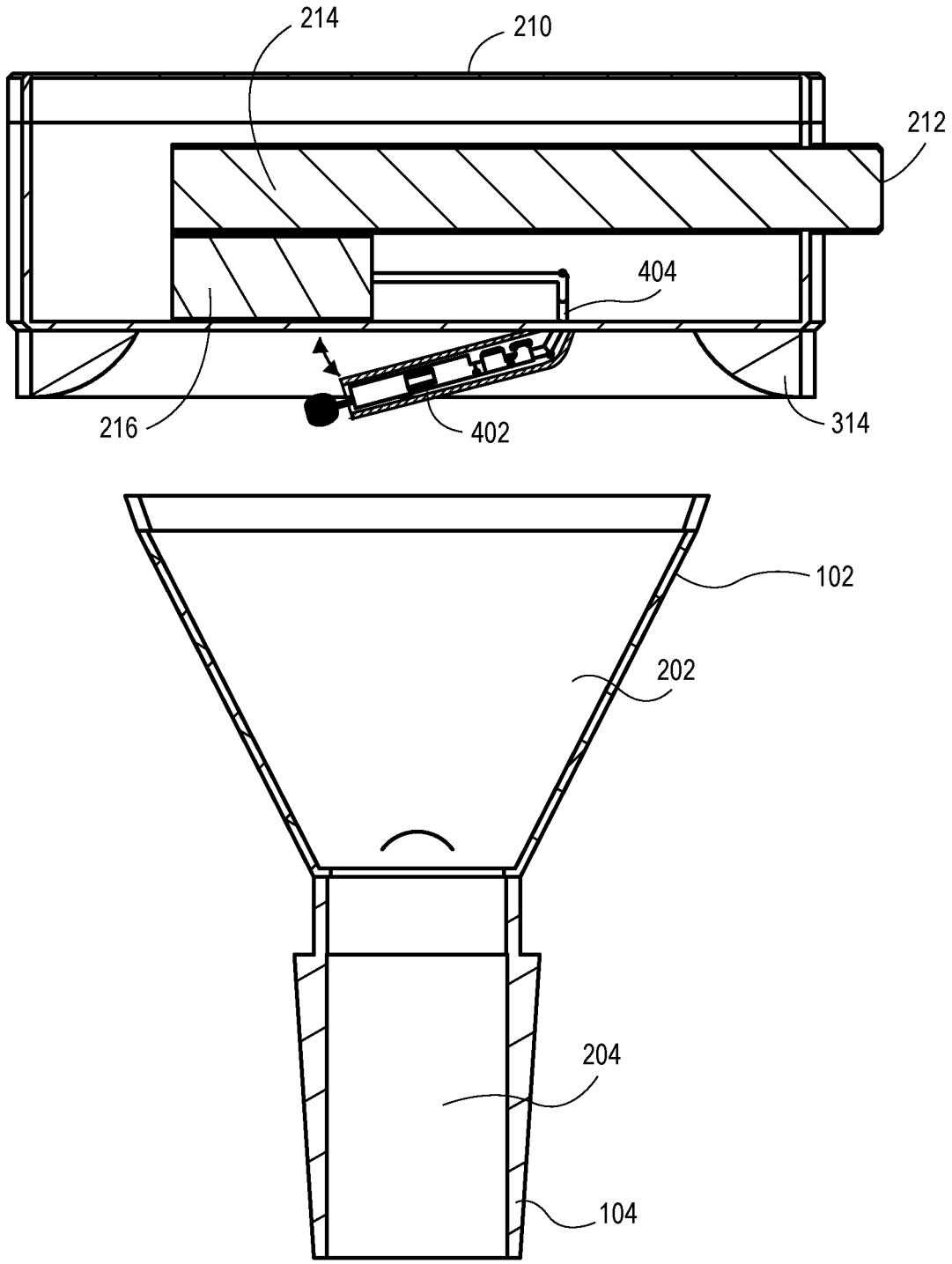
FIG. 4 is a sectional view of the apparatus of FIG. 1 showing some additional optional features.

FIG. 4 is a sectional view of the apparatus of FIG. 1 showing some additional optional features. While this embodiment is in most respects the same as the embodiment described with respect to FIGS. 1-3 is include two features to provide extra protection for the igniter 218. Particularly, a sleeve 402 encases igniter 218 so that only the distal tip of the igniter is exposed. Sleeve 402 can be formed of metal or suitable ceramic material. Additionally, in this embodiment, at east one resilient member 404 couples the igniter 218 to the power source 216. The resilient member weakly biases the igniter 218 out of the cap 110 and into the interior of the bowl 202 when the cap 110 is installed on the bowl 102. For example, a low spring constant leaf spring could be used. By appropriately selecting the spring constant to be low, the igniter will "float" on the herbal content of the bowl 102, rather than experience the stress on the igniter 218 that would exist in a rigid configuration where applying the cap 110 to the bowl 102 would cause the igniter 218 to bury in the bowl contents. Generally, a spring biasing force of one to a few grams is believed to be suitable. Other types of hinges with internal or external springs may be used to accomplish the desired weak bias. Some embodiment may use the resilient member 404 and omit the sleeve 402. Other embodiments may use the sleeve 402 and omit the resilient member. It is expressly intended that either or both of these features may be incorporated into any of the different embodiments described in this specification.

Figure 5:
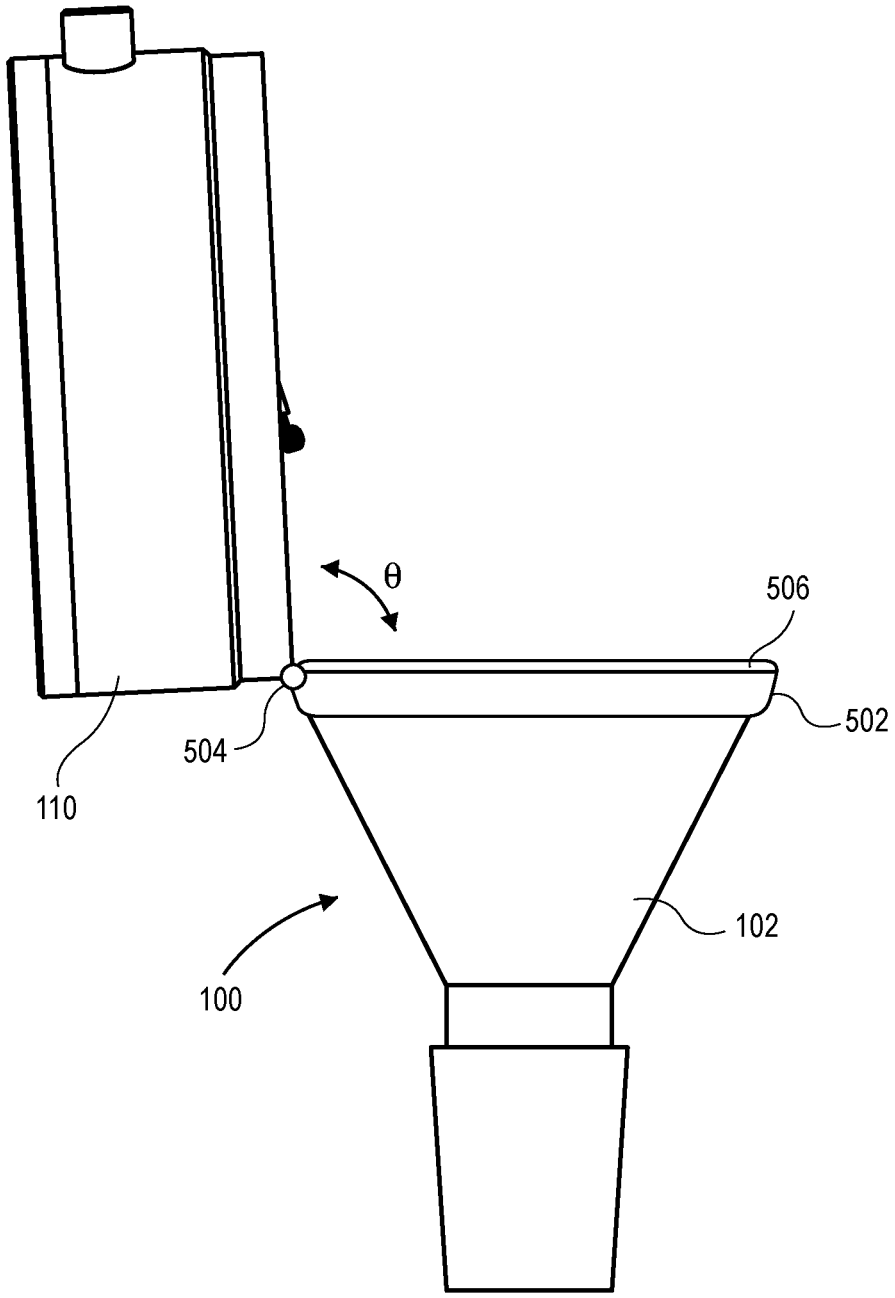
FIG. 5 is a side view of the igniter according to an alternative embodiment of the invention.

FIG. 5 is a side view of the igniter according to an alternative embodiment of the invention. In this embodiment a collar 502 is provided to couple to the bowl piece 100. The igniter cap 110 is couple to collar 502 by a hinge 504 that permits the cap 110 to pivot off the collar through an angle θ which should be ≥90° to permit easy access to the bowl. In some embodiments hinge 504 is a bi-stable hinge. Collar 502 may be formed of metal or a sufficiently heat resistant synthetic material. In some embodiments it may attach to the bowl piece 100 via a threaded attachment that is the collar 502 may be internally threaded and engage corresponding threads on the bowl piece. In other embodiments the collar snap fits over the bowl piece and is held in place by friction between the collar and the bowl piece. In still other embodiments a detent may be provided to engage the lip of the bowl piece to hold the collar 502 in place. Collar 502 may have a gasket 506 at the interface between the collar 502 and the cap 110 to prevent air leakage between these parts. Some embodiment will also include a gasket underlying the collar at the interface between the collar 502 and the bowl piece 100. Such gaskets may be of the same form and materials as described above with reference to gasket 314.

Different embodiments may employ different mechanisms to hold the cap 110 in a closed configuration over the bowl. In one embodiment, a user must apply manual pressure to hold the igniter cap 110 in the closed configuration. In the case hinge 504 is bi-stable, the hinge can apply sufficient force in the closed stable state for the igniter to work hands free. In still other embodiments there may be a magnetic mass attached to the cap 110 and a corresponding magnetic mass attached to the collar 502 such that in a closed configuration the magnetic field between the magnetic masses holds the cap 110 in a closed orientation until a force is applied to overcome that magnetic field. As used herein, "magnetic mass" includes permanent magnets and masses comprising magnetic material upon which a magnet may exert an attractive force. Furthermore, in some cases the collar itself or the housing of the cap 110 may serve as one of the pair of magnetic masses. For example, if the collar 502 is made of a ferromagnetic metal or other magnetic material with a gasket 506 on some portion thereof a permanent magnet attached to the cap could provide sufficient attraction directly to the collar to hold the device in a closed configuration. In some embodiments, a magnetic force in the range of 1-3 newtons is used to hold the cap 110 in the close orientation. A force of 1-3 newtons can readily be obtained using small rare earth magnets as at least one of the magnetic masses.

As indicated above embodiments such as shown in FIG. 5 can benefit from the igniter protection features shown in FIG. 4. Accordingly, some embodiment where the cap 110 is hinged to the collar 502 may also have either or both of a sleeve protecting the igniter 218 or a resilient element that weakly biases the igniter 218 into the bowl during use.

Figure 6:
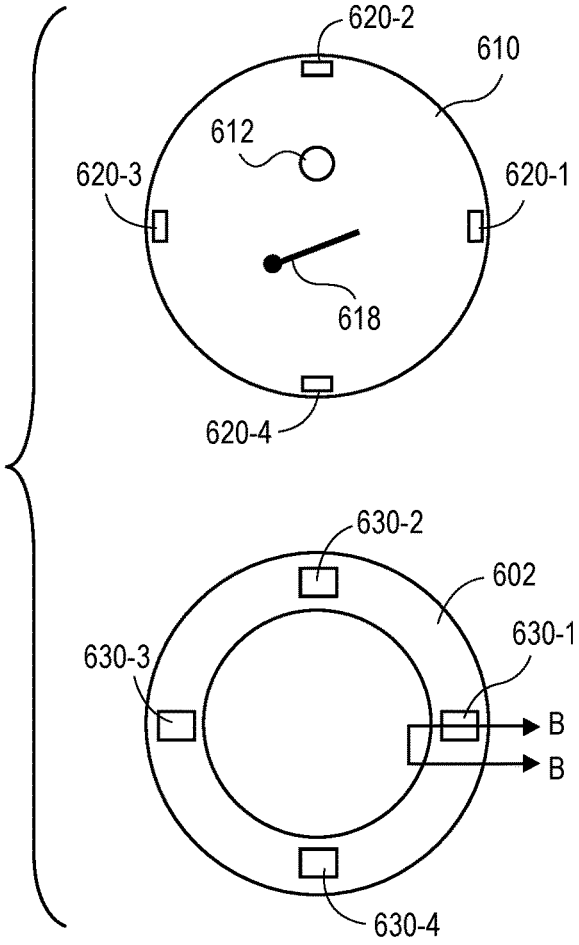
FIGS. 6-7 are schematic representations of coupling mechanisms between the cap and bowl piece according to various embodiment of the invention.
Figure 7:
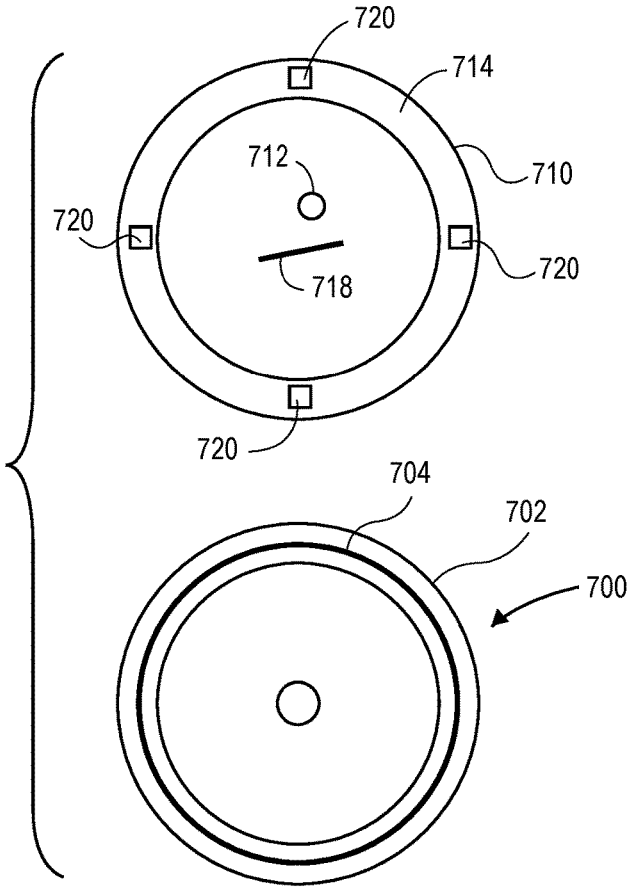

FIGS. 6-7 are schematic representations of coupling mechanisms between the cap and bowl piece according to various embodiment of the invention. In FIG. 6 the underside of cap 610 and the upper side of collar 602 are shown in plan view. Cap 610 has an igniter 618 and an outlet port 612. It also has a plurality of magnetic masses 620-1, 620-2, 620-3, and 620-4 (generically magnetic masses 620). While four magnetic masses 620 are shown more or fewer magnetic masses could be used in various embodiment of the invention. Collar 602 has a corresponding plurality of magnetic masses 630-1, 630-2, 630-3, and 630-4 (generically magnetic masses 630). The attractive force between the magnetic masses 620,630 collectively is desirably in the range of 1-3 newtons.

In some embodiments, by selecting the exhibited polarity of the magnetic masses 620, 630, a particular orientation of the cap relative to the collar can be assured. For example, if magnetic mass 620-1 exhibits a north magnetic pole and magnetic masses 620-2, 620-3, and 620-4 all exhibit a south magnetic pole, and correspondingly, magnetic mass 630-1 exhibits a south magnetic pole while magnetic masses 630-2, 630-3, and 630-4 exhibit a north magnetic pole, there will be exactly one orientation in which the cap 610 and collar 602 will couple. Other embodiment may be orientation agnostic. For example, magnetic masses 620 could all exhibit a north magnetic pole and magnetic masses 630 could exhibit a south magnetic pole or no pole and merely be ferromagnetically active. Again, either or both of the igniter protective features described with reference to FIG. 4 could be used in embodiments with the features described with reference to FIG. 6

Figure 6A:
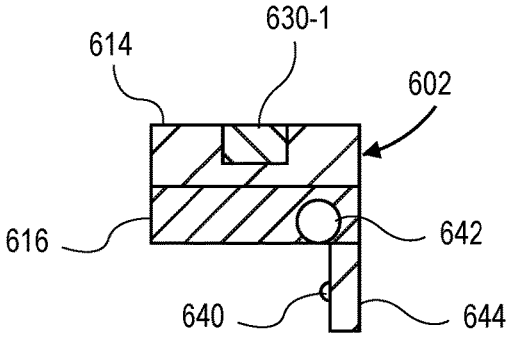
FIG. 6A is a sectional view of the collar of FIG. 6 taken through section B-B.

FIG. 6A is a sectional view of the collar of FIG. 6 taken through section B-B. Magnetic mass 630-1 is shown embedded in gasket 614 which may be laminated to a substrate 616 that can be formed of metal or a suitably heat resistant synthetic material. Gasket 614 provides a substantially hermetic seal between the cap 610 and the collar 602. An additional gasket such as o-ring 642 may be provided to provide a seal between the lip of the bowl and the collar 602. The same elastomers identified above can be used for the gasket material in these embodiments. Collar 602 may have an extension 644 that in use extends over the lip and engages the bowl piece with for example a detent 640 to retain the collar 602 on the bowl piece.

It should be noted that while the described collar allows existing bowl pieces to be retrofitted for use with the igniter cap of various embodiment of the invention. In other embodiment, the bowl piece may be manufactured specifically for use with e.g. the igniter cap 602. In such case the magnetic masses 630 would reside directly in the bowl piece and gasketing could be provided either as part of the bowl piece of as part of the igniter cap for example as described with reference to FIG. 1.

FIG. 7 shows a schematic example of a bowl piece and igniter cap interconnection according to one embodiment of the invention. A bowl piece 700 has inlaid into its lip 702 at least on magnetic mass 704. In this example the magnetic mass is shown as a continuous circle. It could be a steel insert or any other suitable ferromagnetic material. The continuous circle allows attachment of the igniter in any orientation, but a plurality of discrete magnetic masses in any desired polarity scheme (such as those described above with reference to FIG. 6) could be used. Igniter cap 710 has at least on magnetic mass 720 (here 4 are shown). In some embodiments, the distribution of the magnetic masses between the bowl piece 700 and the igniter cap 710 could be reversed. As with the other embodiments, igniter cap defines an outlet port 712 and has an igniter 718. The igniter 718 may include either or both of the protective features described with reference to FIG. 4. A gasket 714 is also provided as part of the igniter cap 710 and may be formed and function as previously described.

Figure 8:
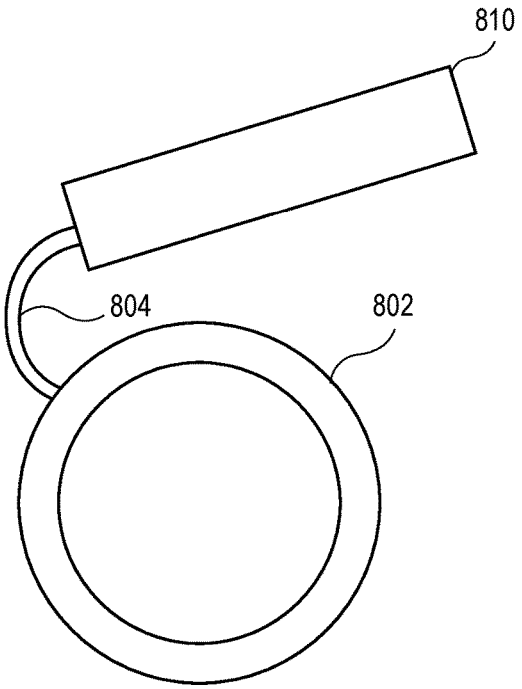
FIG. 8 is a schematic diagram of an alternative embodiment of the invention.

FIG. 8 is a schematic diagram of an alternative embodiment of the invention. Igniter cap 810 may be exactly as described in any of the previously described embodiments. Igniter cap 810 is coupled to an elastomeric collar 802 that may flexibly attach to a bowl piece by an elastomeric tether 804. This feature reduces the risk that the igniter cap will inadvertently be dropped or otherwise decoupled from the bowl piece.

Figure 9:
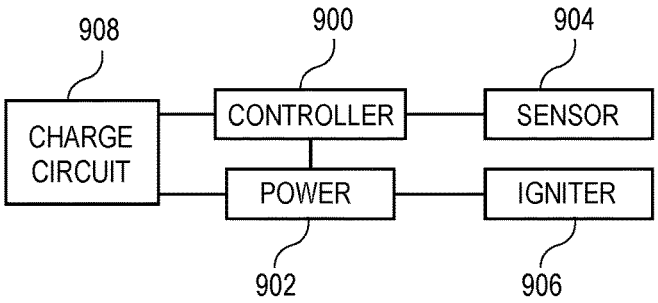
FIG. 9 is a block diagram of the electrical components that form various embodiments of the invention.

FIG. 9 is a block diagram of the electrical components that form various embodiments of the invention. A controller 900 is coupled to a power source 902 and a sensor 904. Controller 900 could be, for example, a microcontroller, a microprocessor, application specific integrated circuit (ASIC), field programmable gate array (FPGA) or the like. During use, the controller 900 receives input from the sensor 904. When the sensor input indicates that a triggering event has occurred, the controller 900 drives the power source 902 to power an igniter 906. For example, sensor 904 may be a pressure sensor that senses pressure changes in a controller airflow path of a water pipe. When a user inhales on the pipe, the pressure change causes the sensor 906 to send a triggering event to the controller.

In some embodiments igniter 906 may be a resistive coil. When powered by power source 902 igniter 906 generates localized heat exceeding 450° F. Power source 902 may be a battery. In other embodiments, igniter may be a ceramic heater also capable of generating localize heat exceeding 450° F. Suitable ceramics include, but are not limited to, zirconia and silicon nitride. Power source 902 may be a rechargeable battery such as a lithium ion battery. In one embodiment, power source 902 is a 3.7 volts battery. Some embodiments may also include a charging circuit 908 coupled to the controller 900 and the power source 902. Generally, charging circuit is responsible for charging the power source 902. In different embodiment, charging circuit may regulate the current from an external charging port or induce current resulting in wireless charging of the power source 902.

Figure 10:
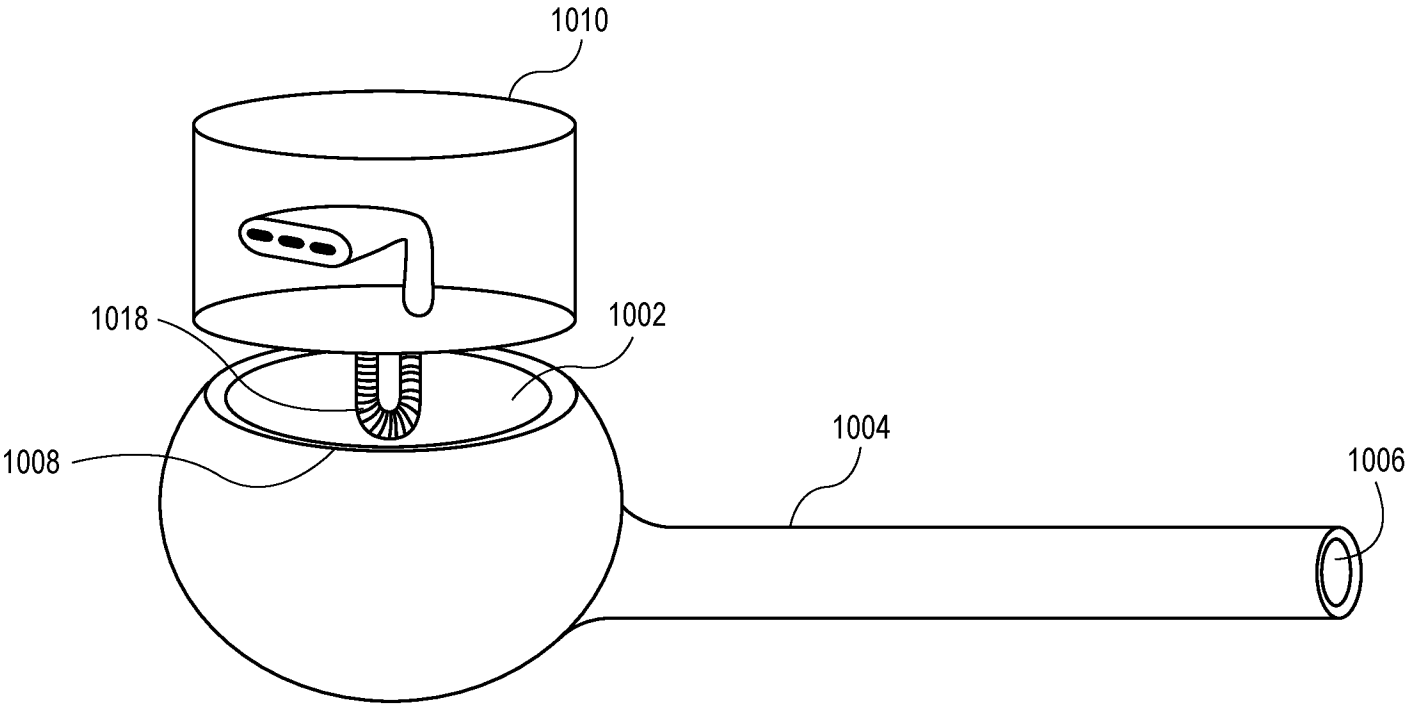
FIG. 10 shows an embodiment of the invention in conjunction with one conventional pipe.

While the majority of the foregoing description focused on water pipes, embodiments of the invention are suitable for use with other types of conventional pipes. All the previously described ignitor caps can be adapted to use with other conventional pipes in which combustion is desired. FIG. 10 shows an embodiment of the invention in conjunction with one conventional pipe. Pipe 1000 has a bowl 1002 and a stem 1004 that terminates in a mouthpiece 1006 through which a user draws smoke during use. Bowl 1002 has a lip 1008 that is engaged by ignitor cap 1010 during use. While any of the previously described embodiment of ignitor caps could be used with pipe 1000, the embodiment shown as ignitor cap 1010 differs from the other described embodiment in that ignitor 1018 is a ceramic heater.

The ceramic heater may be formed in the shape of a blade or other suitable shape. Generally, ceramic heater can efficiently provide localize heat greater than 450° F. and, while more expensive, tend to have superior structural stability when compared to resistive coils. As a result, there may be reduced risk of damage to the ignitor 1018 resulting from insertion into the combustible components within the pipe bowl 1002. It should be understood, ceramic heaters can be used as part of the ignitor for any of the above described embodiments and that embodiment using resistive coils could be used with conventional pipes or water pipes.

In the foregoing specification, the embodiments of the invention have been described with reference to specific embodiments thereof. It will, however, be evident that various modifications and changes can be made thereto without departing from the broader spirit and scope of the invention as set forth in the appended claims. The specification and drawings are, accordingly, to be regarded in an illustrative rather than a restrictive sense.

What is claimed is:

1. An apparatus comprising:

a cap dimensioned to engage a bowl piece having a bowl, the cap providing a restricted air path to the bowl;

a pressure sensor within the cap to sense a pressure change response to air being drawn through the air path;

an igniter that, in use, is exposed within the bowl; and a controller to drive the igniter responsive to a signal from the pressure sensor.

2. The apparatus of claim 1 further comprising:

a power source coupled to the cap.

3. The apparatus of claim 2 wherein the igniter comprises:

a resistive coil and wherein the powers source drives sufficient current through the resistive coil to generate a local temperature of greater than 450° F.

4. The apparatus of claim 1 further comprising:

a coupling member to connect the cap to the bowl piece.

5. The apparatus of claim 4 where in the coupling member comprises:

a plurality of magnetic masses, a first subset of the magnetic masses couple to the bowl and a second subset of the magnetic masses coupled to the cap.

6. The apparatus of claim 1 further comprising:

a resilient element coupled to the igniter to apply a bias force to bias the igniter into the bowl, the resilient element having a relatively low spring constant such that when the bowl is full the bias force is overcome causing the igniter to reside on top of a content of the bowl.

7. The apparatus of claim 1 further comprising:

a protective sleeve encasing the igniter so that only a tip of the igniter is exposed within the bowl.

8. The apparatus of claim 2 further comprising:

a charging circuit coupled to the power source within the cap.

9. The apparatus of claim 8 wherein the charging circuit enables wireless charging of the power source.

10. The apparatus of claim 1 wherein the coupling member comprises:

a collar; and a hinge coupling the collar to the cap.

11. The apparatus of claim 1 further comprising:

gasket to provide a substantially hermetic seal between the cap and the bowl.

12. The apparatus of claim 1 wherein the igniter comprises:

a ceramic heater.

* * * * *